US005773752A

United States Patent [19]

Blume et al.

[11] Patent Number: 5,773,752

[45] Date of Patent: Jun. 30, 1998

[54] COATING COMPOSITIONS WITH IMPACT MARKING CAPABILITY AND METHOD

[75] Inventors: Kevin L. Blume, 12707 W. 43rd St., Nickerson, Kans. 67561; Bo Inge Hakan Gimvang, St. Augustine, Fla.

[73] Assignee: Kevin L. Blume, Nickerson, Kans.

[21] Appl. No.: 595,752

[22] Filed: Feb. 2, 1996

[51] Int. Cl.[6] ..... F42B 12/40

[52] U.S. Cl. ..... 102/513; 106/177.1

[58] Field of Search ..... 102/513; 106/177.1

[56] References Cited

U.S. PATENT DOCUMENTS 3,147,011 9/1964 Lemelson ..... 102/513

5,009,165 4/1991 Morris ..... 102/513

FOREIGN PATENT DOCUMENTS 11907 of 1910 United Kingdom ..... 102/513

*Primary Examiner*—David Brunsman

*Attorney, Agent, or Firm*—John W. Carpenter

[57] ABSTRACT

A composition of matter for producing impact indicia having a dispersing agent; a thickening agent; and a foaming agent. The composition further has a coloring pigment and an emulsifying agent. The composition of matter is placed on a bullet. When the bullet is fired and contacts a target, the bullet produces impact indicia on the target.

4 Claims, No Drawings

COATING COMPOSITIONS WITH IMPACT MARKING CAPABILITY AND METHOD

BACKGROUND OF THE INVENTION

1. Field of the Invention

The present invention relates to a method for firing projectiles, (e.g. bullets), such that when the projectile is fired and/or launched and contacts a desired location, such as a target, a mark will be left at or on the desired location. The present invention more specifically provides for coating compositions with impact marking capability such that when the coating compositions are applied to a projectile and upon firing or launching the projectile, the projectile with impact marking capability will leave an impact mark on or at a desired location.

2. Description of the Prior Art

A patentability investigation was conducted and the following United States Patents were discovered:

U.S. Pat. No. 4,329,393 to LaPerre et al;

U.S. Pat. No. 5,018,450 to Smith; and

U.S. Pat. No. 5,121,692 to DiCarlo.

U.S. Pat. No. 4,329,393 to LaPerre et al discloses coating compositions containing identifier particles for the retrospective identification of particles. LaPerre et al teach that the coating compositions comprise a clear lacquer binder, visually-readable microparticles and reflective spotting particles. The reflective spotting particles facilitate location of the coating on the surface of a tagged article. The term "lacquer binder" as used by LaPerre et al refers to a solution or dispersion of a resin in a vehicle which dries by evaporation and leaves an adherent film on the surface to which it is applied. The term "visually-readable microparticle" as used by LaPerre et al refers to tiny particles, usually less than about 1,000 micrometers at their broadest dimension, which bear a code or indicia of information that is readable by the normal human eye with the aid of a simple magnifying device. LaPerre et al further discloses that the "reflective spotting particles" are glass beads which reflect light back toward a light source so as to make their presence on a surface readily apparent to the eye when a light is focused directly on them.

U.S. Pat. No. 5,018,450 to Smith teaches a luminescent paint ball for marking nighttime impacts. The luminescent paint ball is taught by Smith to be an easily ruptured paint ball type projectile that may be fired from compressed air guns. The paint ball type projectile by Smith is taught to include a double chamber projectile capsule that contains two chemical agents respectively such that when mixed together on impact, the mixture of the two chemical agents provide a luminescent spot to visibly mark impacts at night.

U.S. Pat. No. 5,121,692 to DiCarlo discloses an extractable, reusable, two piece, plastic cartridge, for housing a compression nozzle, a chamber and a pusher disc. One end of the cartridge has an opening to receive a compressionable, halved, hollow point projectile sleeve which contains a soft, compressionable, liquid marking projectile. The pusher disc is located inside the cartridge and is secured to the interior wall of the cartridge by an elastic tube. The disc has a flat forward side which makes complete surface area contact with the projectile sleeve. The aft side of the disc is taught by DiCarlo as being concaved and seated forward of a thrust port. U.S. Pat. No. 5,121,692 to DiCarlo further discloses that the thrust port is the smaller opening of two opening of a conical shaped compression nozzle, which has four equally spaced channels extending from the thrust port longitudinal to the larger opening which joins a circumferencially identical, partially closed end propellant chamber. The chamber, channels and compression nozzle contain a propellant charge. The primer is located aft of the cartridge.

What is needed and what has been invented by us is coating compositions which are to be placed on a projectile (e.g. a head of a bullet) such that when the projectile is fired at a desired location (e.g. a target), the projectile will travel with impact marking capabilities. When the projectile hits the desired location, the point of contact of the projectile with the desired location (e.g. a target) will be marked. The conventional way of identifying where a bullet hit a target is to use binoculars and after every shot, one kept a pad and pencil record of where the bullet hit the target. The present invention is an improvement over the conventional way of recording where a bullet hit a target.

SUMMARY OF THE INVENTION

The present invention accomplishes its desired objects by providing a composition for producing impact indicia, which composition is to be disposed on a projectile such that when the projectile is fired into or against a desired location, such as a target, impact indicia is produced on the desired location. The composition for producing impact indicia comprises a dispersing agent, a thickening agent, a defoaming agent, a coloring agent, and an emulsifying agent. The composition for producing impact indicia includes from about 1% by weight to about 20% by weight of the dispersing agent; from about 0.01% by weight to about 3% by weight of the thickening agent; and from about 0.004% by weight to about 0.30% by weight of the defoaming agent. The composition further includes from about 20% by weight to about 80% by weight of the coloring pigment; and from about 0.4% by weight to about 9% by weight of the emulsifying agent.

The dispersing agent is preferably an acid (e.g. polyacrylic acid), which is more preferably in an aqueous solution such as water. The thickening agent is preferably a cellulose polymer, such as an alkyl cellulose polymer wherein the alkyl group contains from 1 to 10 carbon atoms. The defoaming agent is preferably a silicone defoaming agent such as an alkyl silicone agent wherein the alkyl group contains from 1 to 10 carbon atoms. The coloring pigment may be any suitable inorganic and/or organic powder or paste. The coloring pigment is typically an iron oxide. Similarly, the emulsifying agent may be any suitable emulsifying agent which is capable of producing the results of the present invention, such as a wax emulsifying agent (e.g. PTFE).

The present invention further accomplishes its desired objects by providing a method for producing impact indicia on a desired location comprising the steps of providing a desired location, providing a projectile, disposing on the projectile a composition for producing impact indicia, and projecting the projectile against the desired location for producing impact indicia on a desired location.

It is therefore an object of the present invention to provide a method for producing impact indicia on a desired location such as a target.

It is another object of the present invention to provide a composition for producing impact indicia.

These, together with the various ancillary objects and features which will become apparent to those skilled in the art as the following description proceeds, are attained by this composition for producing impact indicia and method.

DETAILED DESCRIPTION OF THE INVENTION

The present invention provides for a chemical composition of matter that is for producing impact indicia on a desired location, such as a target having a bull's eye surrounded by a plurality of concentric rings or circular indicia. The chemical composition of matter of the present invention is preferably placed on the bullet part of a projectile; and when the bullet part is projected or fired away by a propellant substance (e.g. gun powder contained in a shell which is in contact with the bullet).

The chemical composition for producing impact indicia comprises a dispersing agent, a thickening agent, a defoaming agent, a coloring pigment, and an emulsifying agent. The chemical composition of the present invention preferably comprises from about 1% by weight to about 20% by weight of the dispersing agent; from about 0.01% by weight to about 3% by weight of the thickening agent; from about 0.004% by weight to about 0.30% by weight of the defoaming agent; from about 20% by weight to about 80% by weight of the coloring pigment; and from about 0.40% by weight to about 9% by weight of the emulsifying agent.

The chemical composition of the present invention more preferably comprises from about 5% by weight to about 10% by weight of the dispersing agent in an aqueous solution; from about 0.1% by weight to about 0.6% by weight of the thickening agent; from about 0.02% by weight to about 0.06% by weight of the defoaming agent; from about 35% by weight to about 65% by weight of the coloring pigment; and from about 2% by weight to about 6% by weight of the emulsifying agent.

The aqueous solution (i.e. water) containing the dispersing agent preferably comprises from about 1% by weight to about 75% by weight of the dispersing agent; more preferably from about 10% by weight to about 50% by weight of the dispersing agent; most preferably from about 20% by weight to about 30% by weight of the dispersing agent.

The dispersing agent for the present invention is for dispersing the coloring pigment. The dispersing agent is preferably an acid; more preferably an acid selected from the group consisting of polyacrylic acid, ploymethylacrylic acid and mixtures thereof; most preferably the acid is polyacrylic acid.

The thickening agent for the present invention functions as a filler to give the chemical composition for producing impact indicia a thickened body. The thickening agent is preferably a cellulose polymer; more preferably an alkyl cellulose polymer wherein the alkyl group in the alkyl cellulose polymer has from 1 to 10 carbon atoms; most preferably methylcellulose polymer.

The defoaming agent for the present invention is for preventing the chemical composition for producing impact indicia from foaming or becoming too aerated, especially in the formation of the chemical composition. The defoaming agent is preferably a silicone defoaming agent; more preferably an alkyl silicone defoaming agent wherein the alkyl group in the alkyl silicone defoaming agent has from 1 to 10 carbon atoms; most preferably methylsilicone.

The coloring pigment for agent of the present invention is for giving the chemical composition for producing impact indicia a color. The color may be any desired color, such as red, blue, green, or any other color that would furnish the chemical composition for producing impact indicia with impact indicia capabilities such that when the projectile hits on a desired location, the point of impact would be readily discernible by the color of the coloring pigment. The coloring pigment may be based on any inorganic and/or organic powder or paste. Preferably, the coloring pigment is a coloring powder selected from the group consisting of an inorganic coloring powder, an organic powder, and mixture thereof; more preferably the coloring powder is an inorganic coloring powder; most preferably the coloring powder comprises iron oxide.

The emulsifying agent for the present invention may be any suitable emulsifying agent that is capable of maintaining all of the chemicals in the chemical composition homogeneously dispersed and/or homogenized. The emulsifying agent is preferably a wax emulsifying agent; more preferably the emulsifying agent comprises polytetrafluroethylene (PTFE).

The chemical composition of matter for the present invention that produces impact indicia on a desired location may be produced or formulated by placing the dispersing agent (i.e. the aqueous solution containing the dispersing agent), the thickening agent, the defoaming agent, the coloring pigment and the emulsifying agent in a suitable container and agitating the chemicals in the suitable container until all of the chemicals have been thoroughly mixed together. Agitation may be typically accomplished by grinding the chemicals within the suitable container in a high speed dispersing mill for a suitable time (e.g. from about 5 minutes to about 60 minutes) until a uniform paste is produced. The paste preferably has a Hegman Grind ranging from about 5 to about 8, more preferably from about 6 to about 7. The Hegman Grind is a standard for particle sizing. After the paste is formulated, the paste may be suitably packed (e.g. hermetically packed or disposed in a container that is capable of being sealed hermetically to prevent drying out of the paste). The paste may be admixed with water until a desired viscosity is obtained. The quantity of water would typically range from about 15% by weight to about 70% by weight of the produced chemical composition of matter that is capable of producing impact indicia. The water may be added to the paste before hermetically packing the paste, or the water may be added to the paste after hermetically packing and subsequently after that hermetically packed paste has been opened and when it is desired to use the chemical composition with projectile or bullet.

After the chemical composition of the present invention has been prepared, the chemical composition may be employed to practice a method for producing impact indicia on a desired location. The method includes selecting a desired location, such as providing a target; and selecting or providing a desired projectile which may be any projectile that is capable of being projected or fired on a desired location such as a selected target. Subsequently, the initially prepared chemical composition is disposed or placed on the projectile, and the projectile is projected or fired against the desired location or target, causing or producing an initial impact indicia on the desired location or target when the projectile hits or strikes the same. The method may additionally include providing another chemical composition having the same or different color than the initial chemical composition. A second projectile is selected and the second composition is placed on the second projectile. When the second projectile is projected or fired against the desired location or target, a second impact indicia is produced on the desired location or target. If the second chemical composition has a different color than the initial chemical composition, the second impact indicia will have a different color than the initial impact indicia. The projectile is preferably a bullet bound to a shell containing a propellant substance (i.e. a firing substance). The chemical composition is disposed on the bullet such that when the bullet strikes or enters through or into the desired location or target, impact indicia is produce on the desired location or target.

The present invention will now be illustrated by the following example which sets forth the presently known best mode of operation. The following example is not to be construed as limiting the present invention, but is set forth hereinafter for producing a presently known best mode and for further describing the invention.

EXAMPLE

Water containing about 25% by weight of polyacrylic acid was placed in a container along with methylcellulose polymer, methylsilicone defoaming agent, iron oxide, and polytetrafluroethylene. The foregoing chemicals were all placed in the container in quantities such that the chemical composition to be produced contains about 7.5% by weight of the water containing polyacrylic acid; about 0.35% by weight of the methylcellulose polymer; about 0.04% by weight of the methylsilicone defoaming agent; about 50% by weight of iron oxide; and about 4% by weight of polytetrafluroethylene. The foregoing chemicals were thoroughly mixed by grinding in a high speed dispersing mill for about 30 minutes. A chemical paste produced had a Hegman Grind of about 6. Subsequently, water was added to decrease the viscosity of the chemical paste to a desired viscosity. The quantity of water added was of such a quantity that the chemical composition contained about 61.89% by weight of the added water.

After the chemical composition was produced it was used as a tracing system in target practice.

To properly use the produced chemical composition, one must determine what type of magazine one's firearm uses. More specifically, is the type of magazine a first in bullet first out bullet type bullet system, or is the magazine a first in bullet last out bullet type bullet system. After such a determination, a bullet (i.e. the part of a bullet-shell-propellant powder system that leaves the shell/powder after being fired) is dipped in the produced chemical composition. It should be understood that while dipping has been stated, the produced chemical composition may be placed on the bullet by any suitable manner, such as by spraying, brushing, etc. The bullet is to be dipped into the chemical composition such that only the right amount of chemical composition is employed. We have discovered that the chemical composition is to only cover the tip or at least part of the tip of the bullet (i.e. not the entire bullet). Preferably and since the head of a bullet is tapered, the chemical composition is to be applied to the tapering head or tapering tip of the bullet such as to cover the outside of the tapering head or tapering tip of the bullet up to a point where the diameter of the tapering head or tip at that point has a size or measurement that is approximately from about 20% percent to about 40% percent of the diameter of the largest cylindrical section of the bullet; more preferably approximately from about 25% to about 35% of the diameter; most preferably approximately about 30% of the diameter of the bullet. Stated alternatively, the tapering tip or tapering head of the bullet is to be covered with the chemical composition up to a point on the tip or head, a generally circular point where the diameter of the tapering tip or tapering head (i.e. a generally conical tip or head) at that generally circular point has a magnitude that ranges from about 20% to about 40% of the diameter of the cylindrical section of the bullet; more preferably ranging from 25% to about 35% of the diameter of the cylindrical section of the bullet; and most preferably ranging from about 28% to about 32% of the diameter of the cylindrical section of the bullet. As indicated, the diameter of the cylindrical section of the bullet is to be determined from the largest cylindrical section of the bullet. Thus, for a uniformed tapering tip or head of a bullet, less than about half of the tip or head of the bullet is covered.

If it is desired to use a different color for each round or bullet fired, a number of different chemical compositions must be produced such that each contains a different color. The color of the coloring pigment determines the color of the chemical composition. Furthermore, the color of the impact indicia to be produced on a target is determined by the color of the chemical composition. For example, if there are six bullets to be fired from a magazine, each bullet may have a different color. By way of example only: the first bullet may be green on its associated tip, the second bullet red, and third bullet blue, the fourth bullet yellow, the fifth bullet silver and the sixth bullet purple. By employing a different color for each bullet to be fired, one may readily determine which bullet or shot hit where on the target. If there are more than one person shooting at the same target, each person may have a different color such that when each person shoots at the same target, all will know who shot where on the target.

After the shooting area is clear, the bullet is fired at the target and a color ring around a bullet hole will mark each shot. The target art or tracing system of the present invention marks each shot instantly so one may shoot as fast or slow as one likes.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

We claim:

1. A method for producing impact indicia on a desired location comprising the steps of:

(a) providing a desired location;

(b) providing a projectile;

(c) disposing on said projectile of step (b) a composition for producing impact indicia; said composition for producing impact indicia comprises a dispersing agent; a thickening agent; a defoaming agent; a coloring pigment; and an emulsifying agent; said dispersing agent is an acid; said thickening agent is a cellulose polymer; said defoaming agent is a silicone defoaming agent; said coloring pigment is a coloring powder selected from the group consisting of an inorganic coloring powder, an organic coloring powder, and mixtures thereof; and said emulsifying agent includes a wax emulsifying agent; said acid is selected from the group consisting of polyacrylic acid, polymethylacrylic acid, and mixtures thereof; said cellulose polymer comprises an alkylcellulose polymer wherein the alkyl in said alkylcellulose polymer includes from 1 to 10 carbon atoms; said silicone defoaming agent comprises an alkylsilicone agent wherein the alkyl in said alkylsilicone agent includes from 1 to 10 carbon atoms; said inorganic coloring powder comprises iron oxide; and said wax emulsifying agent comprises polytetrafluroethylene; and said alkylcellulose polymer comprises methylcellulose polymer; and said alkylsilicone defoaming agent comprises methylsilicone as said defoaming agent; and (d) projecting said projectile of step against said desired location for producing impact indicia on said desired location.

2. The method of claim 1 additionally comprising providing a second composition for producing second impact indicia; providing a second projectile said second composition for producing second impact indicia; and projecting said second projectile against said desired location, producing second impact indicia on said desired location.

3. The method of claim 1 wherein said projectile includes a bullet bound to a shell containing a firing substance; and said disposing step (c) comprises disposing said composition for producing impact indicia on said bullet; and said projecting step (d) comprises firing said bullet against said desired location.

4. The method of claim 1 wherein said composition comprises from about 1% by weight to about 20% by weight of said dispersing agent; from about 0.01% by weight to about 3% by weight of said thickening agent; from about 0.004% by weight to about 0.30% by weight of said defoaming agent; from about 20% by weight to about 80% by weight of said coloring pigment; and from about 0.40% by weight to about 9% by weight of said emulsifying agent.

* * * * *